US008025187B2

(12) United States Patent
Sottosanti, Jr. et al.

(10) Patent No.: US 8,025,187 B2
(45) Date of Patent: Sep. 27, 2011

(54) IN-STORE COMBINED SAMPLE DISPENSER AND MERCHANDISING PRODUCT DISPLAY

(75) Inventors: Vincent William Sottosanti, Jr., Stamford, CT (US); Andrew Zachery Wilder, Brewster, NY (US)

(73) Assignee: Conopco, Inc., Englewood Cliffs, NJ (US)

( * ) Notice: Subject to any disclaimer, the term of this patent is extended or adjusted under 35 U.S.C. 154(b) by 426 days.

(21) Appl. No.: 12/274,536

(22) Filed: Nov. 20, 2008

(65) Prior Publication Data

US 2009/0294479 A1 Dec. 3, 2009

Related U.S. Application Data

(60) Provisional application No. 61/057,914, filed on Jun. 2, 2008.

(51) Int. Cl.
*B67D 5/42* (2006.01)

(52) U.S. Cl. ..... 222/192; 222/251; 211/85.26; 206/557

(58) Field of Classification Search ..... 222/192, 222/251, 93, 185.1, 105; 206/557; 211/85.26
See application file for complete search history.

(56) References Cited

U.S. PATENT DOCUMENTS

| | | | | |
|---|---|---|---|---|
| 3,308,961 | A * | 3/1967 | Chesley | 211/59.3 |
| 7,611,033 | B2 * | 11/2009 | Ganzeboom | 222/190 |
| 2008/0006692 | A1 | 1/2008 | Gillespie et al. | |

FOREIGN PATENT DOCUMENTS

| | | |
|---|---|---|
| EP | 0 134 142 | 8/1984 |
| FR | 2637168 | 10/1988 |
| FR | 2712471 | 11/1993 |
| WO | 02/053085 A2 | 7/2002 |

OTHER PUBLICATIONS

PCT International Search Report PCT/EP/2009/056660.
PCT Written Opinion PCT/EP2009/056660.

* cited by examiner

*Primary Examiner* — Kevin P Shaver
*Assistant Examiner* — Donnell Long
(74) *Attorney, Agent, or Firm* — Milton L. Honig

(57) ABSTRACT

A combined sample dispenser and merchandising unit product display and related method is provided herein. Included is an elongate tray having a first end and a second end, an upper compartment with open roof for standing a plurality of merchandising unit products each containing a flowable substance, and a lower compartment arranged directly below the upper compartment. A sample dispenser is provided which includes a dispensing unit arranged against the first end of the tray and a reservoir holding sampling amounts of the flowable substance, communicating with the dispensing unit and arranged within the lower compartment.

8 Claims, 6 Drawing Sheets

IN-STORE COMBINED SAMPLE DISPENSER AND MERCHANDISING PRODUCT DISPLAY

BACKGROUND OF THE INVENTION

1. Field of the Invention

The invention concerns a device and method which allows a consumer to test products, especially personal care liquid products prior to purchase in a retail establishment.

2. The Related Art

Retail stores and especially the department and specialty cosmetic stores have counters displaying open packages for allowing consumers to test products. Some of these products are open jars containing creams. More frequently test samples are in pump dispenser bottles. Usually there is very little supervision in the sampling. Chances are high for microbial contamination. Although apparently secure, even pump bottles are sometimes unscrewed so a consumer can more accurately smell the fragrance component of a lotion/cream on display.

In instances where a consumer is favorably inclined after sampling to purchase, the product may be difficult to locate. This results from the sample dispenser not being located closely adjacent to a purchasable unit of product.

Still another issue is the scarcity of shelf space. Retailers prefer to use shelf space for purchasable product rather than for bulky non-revenue generating sample dispensers.

Accordingly, it is a prime object of the present invention to co-locate units of merchandisable product with a sample dispenser allowing consumers to evaluate product prior to purchase. Moreover, the present invention seeks to minimize the footprint on-shelf of a sample dispenser.

SUMMARY OF THE INVENTION

A combined sample dispenser and merchandising unit product display is provided which includes:

(i) an elongate tray including a first end and a second end, an upper compartment with open roof for standing a plurality of merchandising unit products each containing a flowable substance, and a lower compartment arranged directly below the upper compartment; and (ii) a sample dispenser which includes a dispensing unit arranged against the first end of the tray and a reservoir holding sampling amounts of the flowable substance, communicating with the dispensing unit and arranged within the lower compartment.

BRIEF DESCRIPTION OF THE DRAWING

Further advantages and features of the present invention will better be understood through consideration of the following drawing in which.

DETAILED DESCRIPTION OF THE INVENTION

Now there has been discovered a structural arrangement wherein the footprint of a sample dispenser can be co-located with a related merchandising unit product display. Not only can a consumer evaluate product, but a purchasable container filled with identical sample product is readily at hand.

The invention is intended for placement on a shelf of a retail store alongside either rows of plastic bottles or other trays with rows of plastic bottles containing purchasable product. A consumer prior to purchase can sample a dollop of the liquid product from the sample dispenser.

Figure 1:
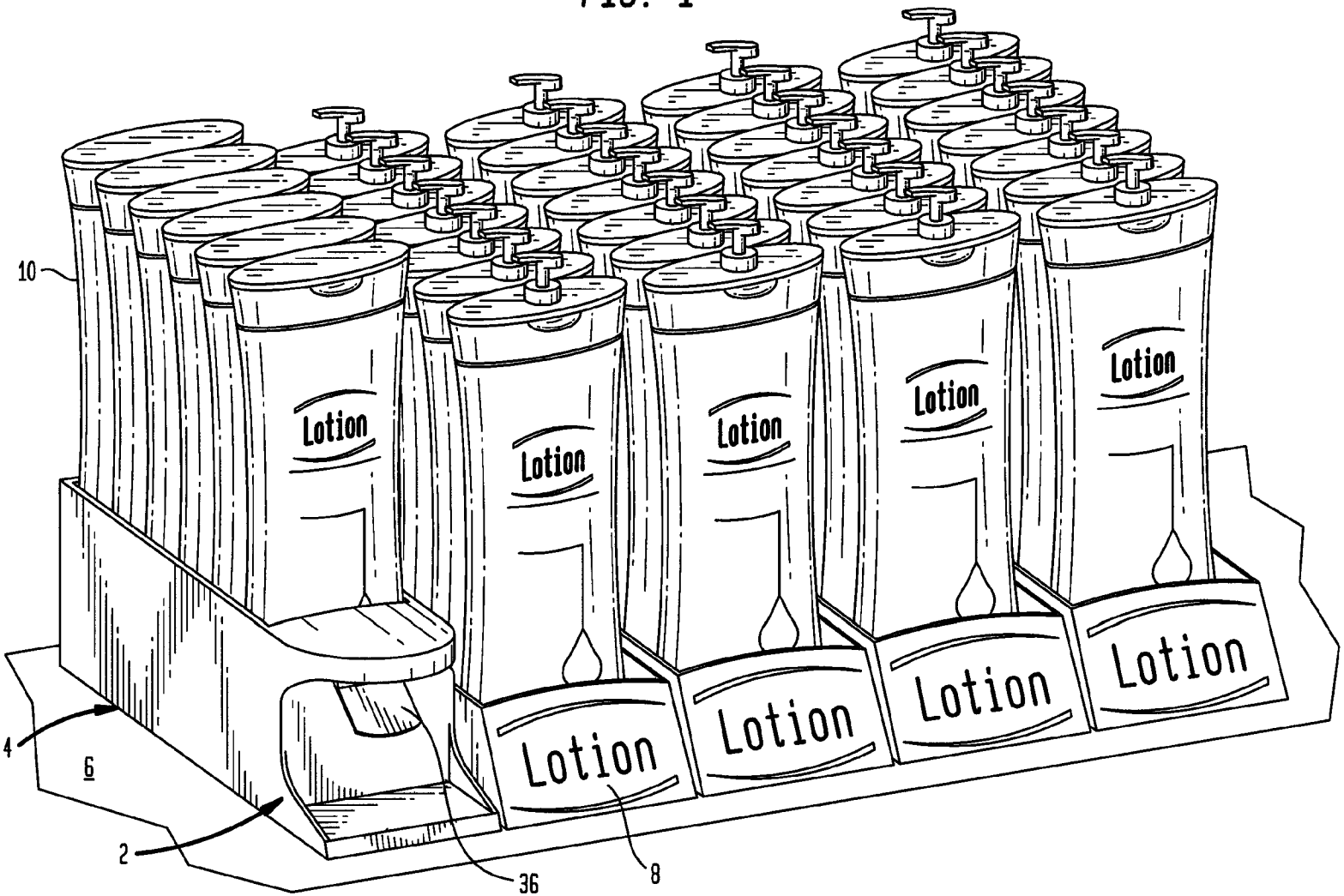
FIG. 1 is a perspective view of our combined sample dispenser and merchandising unit product display resting on a store shelf interlocked with an adjacent but non-sample dispensing set of related display trays.

FIG. 1 illustrates a combined sample dispenser 2 and merchandising unit product display 4. The combined dispenser and display rests on a shelf 6 of a retail establishment adjacent a series of four related displays 8 holding identical product but in different container sizes and formats (e.g. pump and flip-top cap). These adjacent displays do not have any sample dispenser. Instead the related displays are positioned interlockingly with display 4 fitted with the sample dispenser 2.

Figure 2:
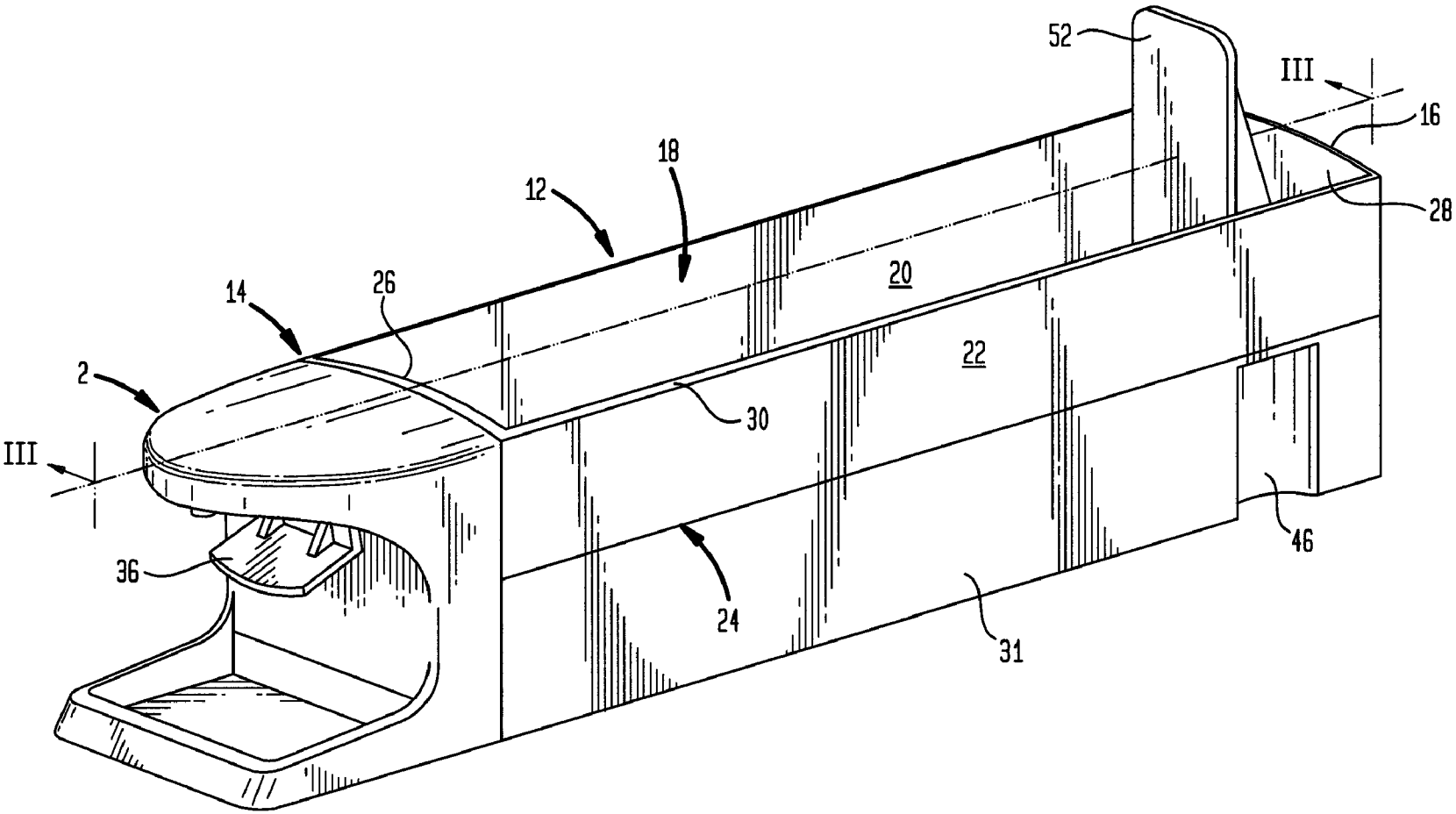
FIG. 2 is a perspective view of the sample dispenser and merchandising unit product display similar to FIG. 1 except absent the merchandising unit products.

FIG. 2 reveals more details of the combined sample dispenser and merchandising unit product display. The standingly stacked unit product containers 10 shown in FIG. 1 have been removed for clarity purposes. The display includes an elongate tray 12 having first and second ends 14, 16. Tray 12 features an upper compartment 18 having a pair of side walls 20, 22, a floor 24, first and second end walls 26 and 28, and an open roof 30 defined by upper edges of the side and end walls.

Figure 3:
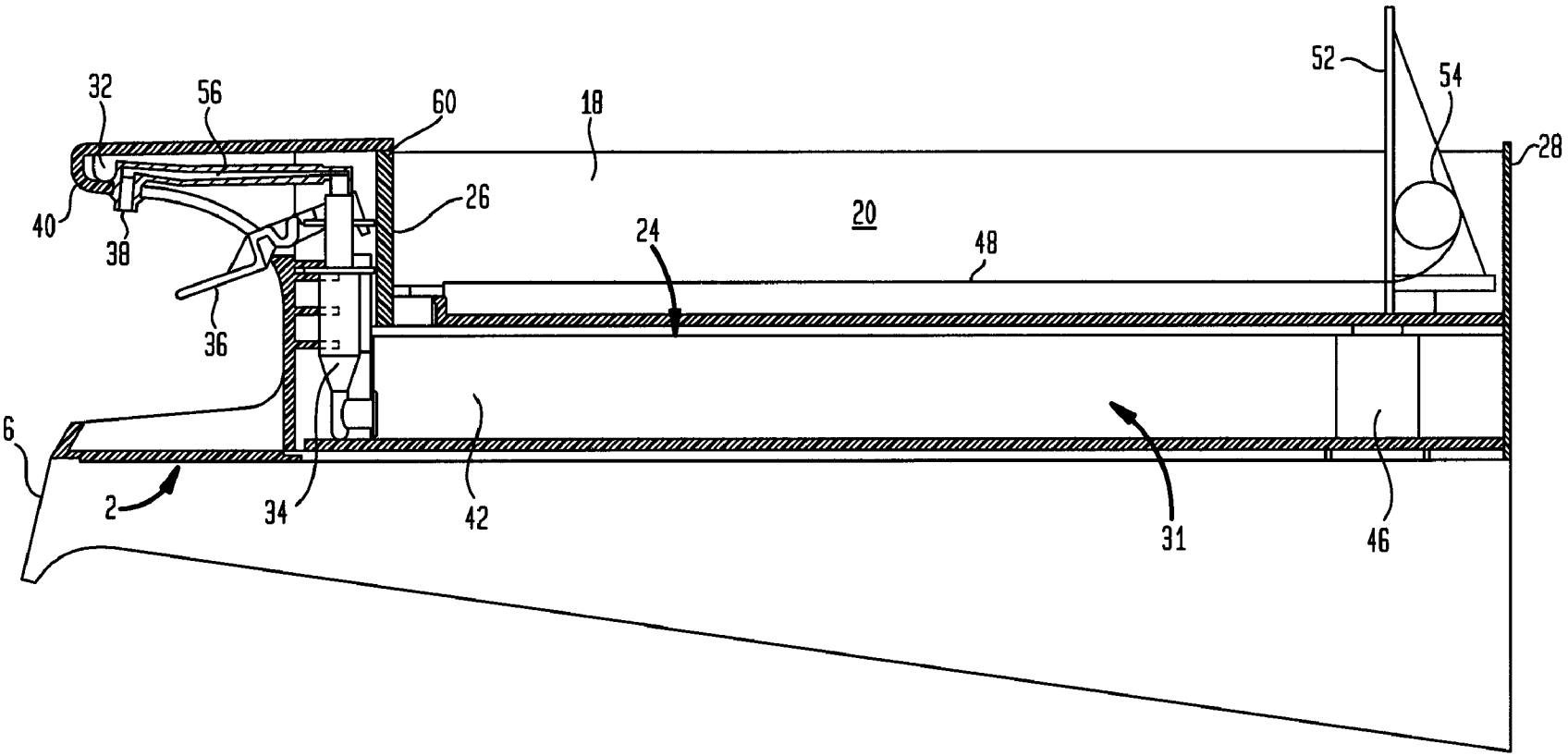
FIG. 3 is a cross-sectional view along line III-III of FIG. 2.

FIG. 3 best illustrates mechanical components of the sample dispenser 2. A U-shaped housing 32 surrounds a pump 34. The pump is activated by a lever 36 protruding from the housing. A dispensing nozzle 38 is arranged pointing downward from an upper fork 40 of the housing. Sampling amounts of a flowable substance are stored in a flexible walled elongate bladder serving as a reservoir 42. An elongate rectangular paperboard carton 44 surrounds the reservoir 42 and is fittingly inserted within the lower compartment 31 of the tray. Carton 44 is fitted with slits in a side wall of the carton near an end opposite that from which the pump draws sampling amounts. The slits permit a slight compression of the carton walls as the carton is inserted into the lower compartment moving past indentations 46 of the lower compartment walls. These indentations lockingly secure the reservoir and sample dispenser to the tray. When the aforementioned components are sought to be separated, inward thumb pressure against the indentations 46 releases the reservoir and surrounding carton.

Figure 4:
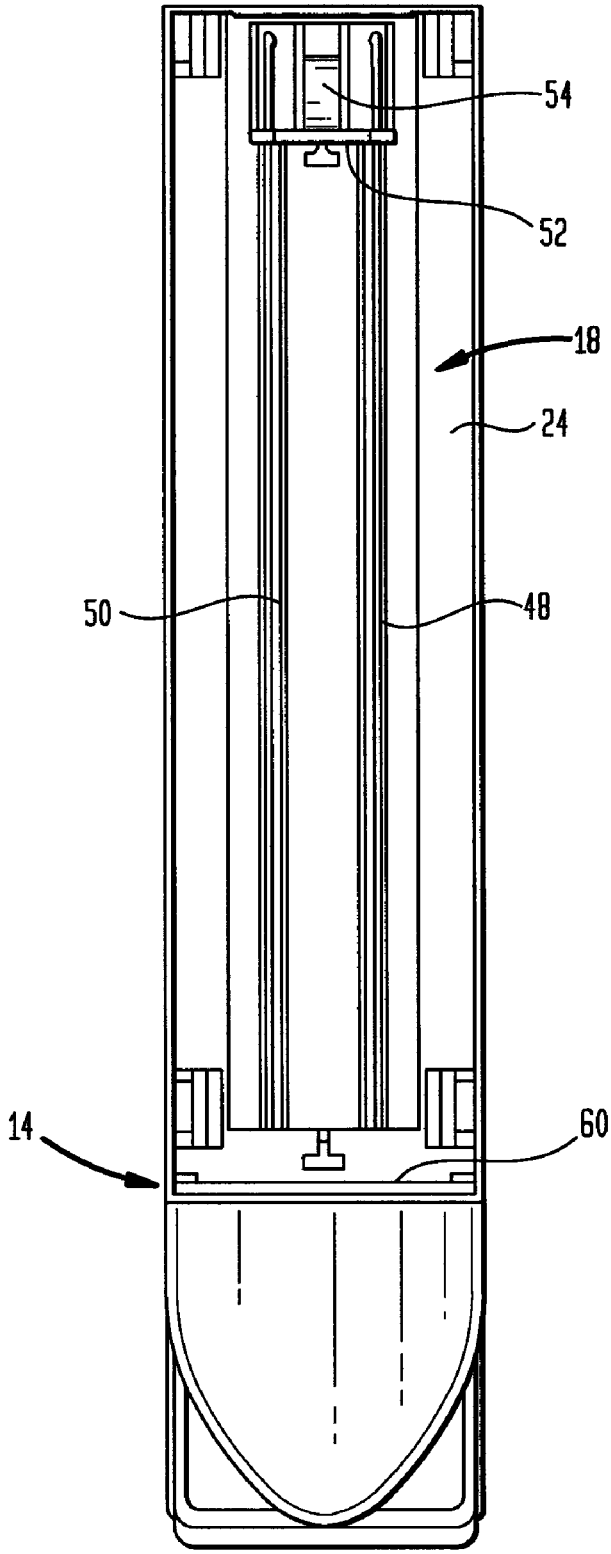
FIG. 4 is a top plan view of the combined dispenser and display shown in FIG. 2.

FIG. 4 in a top plan view best illustrates the upper compartment 18. Along floor 24 are a set of parallel tracks 48, 50. Containers of product 10 (shown in FIG. 1 but not in FIG. 4) stand upright in stacked relationship within the upper compartment of the tray. A support panel 52 is movably urged along the parallel tracks 48, 50 by a coiled spring 54. The support panel insures that the plurality of product containers 10 remain standing flush against one another and as close as possible to the first end 14 of the tray. Ordinarily the trays can accommodate anywhere from 4 to 40, preferably from 6 to 25, optimally from 8 to 15 product containers.

The combined sample dispenser and merchandising unit product display operates in the following manner. A consumer wishing to evaluate advertised product will place their hand palm upwards within the U-shaped housing of the sample dispenser. The consumer's hand will then apply upward pressure against lever 36. Upward motion of the lever initiates a downward stroke of pump 34 resulting in a discrete amount of sample moving from the flexible bladder reservoir 42 downstream to the pump and from there through a conduit 56 exiting at nozzle 38. Evacuation of product from the reservoir 42 causes vacuum contraction of the flexible bladder and will eventually require replacement. The collapsing mechanism does not require a dip tube for transporting liquid from a bottom closed end towards the pump. In the present system, sample product at the distant end of the bladder is the last portion of product to be evacuated.

Amounts of sampling substance can be monitored through a window 62 of carton 44. In a preferred embodiment, a colored area is positioned below the flexible bladder reservoir 42. As the bladder evacuates, it flattens and becomes more transparent. In turn, the colored area as viewed from window 62 becomes visibly more intense. The level of the color intensity signals the level of remaining sampling amount.

Figure 5:
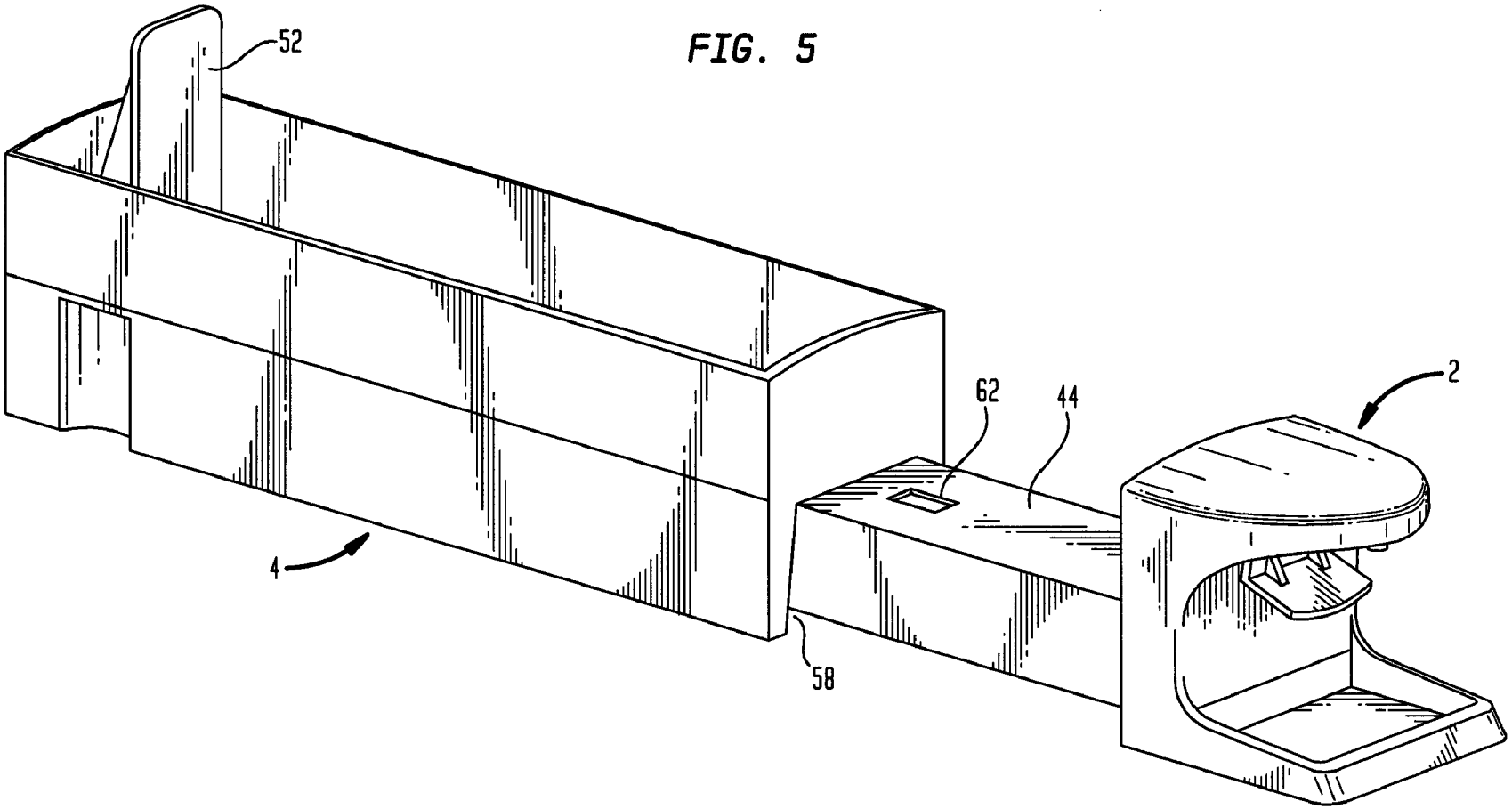
FIG. 5 is a perspective view of the sample dispensing unit being separated from an elongate tray component of the combined dispenser and merchandising unit product display.

FIG. 5 best illustrates how the sample dispenser is replaced. Thumb pressure is applied against indentations 46 on either side of the second end of the tray. This helps release sample dispenser 2 from engagement against the first end 14 of the tray. The dispensing device constituted of the housing 32, pump 34, lever 36, dispensing nozzle 38 and conduits is pulled outward away from the first end of the tray. Concomitantly this motion withdraws the paperboard carton with flexible bladder reservoir. If a refill sample dispensing unit 2 is available, it will be inserted in an operation reversed from that of the aforedescribed removal procedure. In the event, a replacement is not immediately available, an opening 58 at the first end of the lower compartment can be sealed by a door 60 downwardly movable from a storage position along the first end of the upper compartment 18.

A concept, but not the only one of the present invention, is that the lever 36 for actuating dispensing as well as the reservoir 42 is positioned below the dispensing nozzle 38. The arrangement allows easy access of a human hand in a single action to receive a dollop sample from the nozzle concomitant with moving the lever. Systems of this type ordinarily position product sump about the nozzle/lever. By moving the sump or reservoir below the pump and nozzle/lever, space is left at an upper end to allow product display in a merchandising unit.

Figure 6:
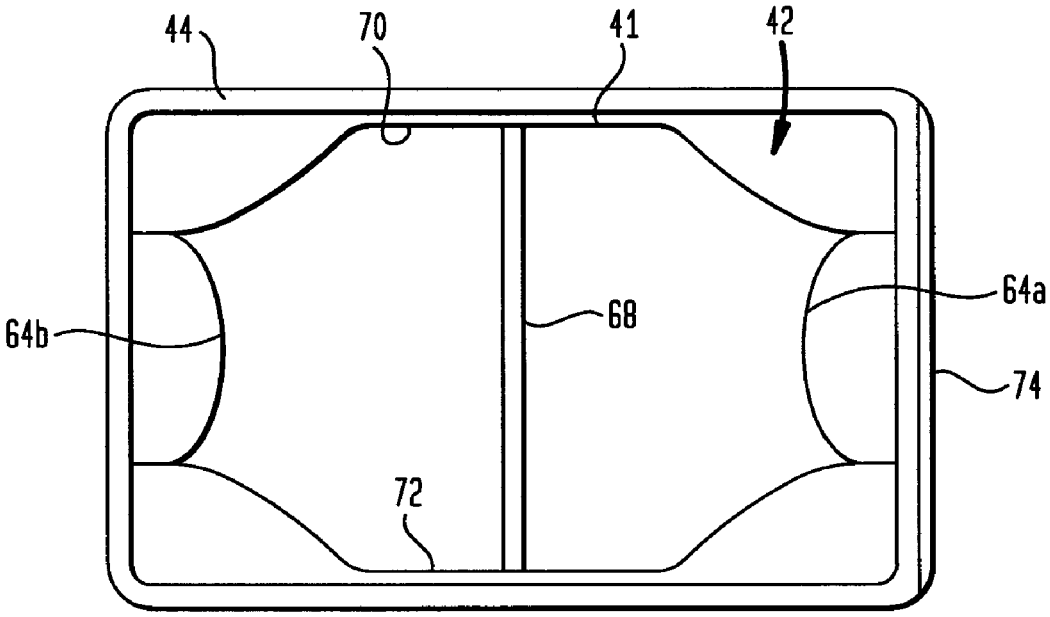
FIG. 6 is a cross-sectional view along line VI-VI of FIG. 5.

FIG. 6 best illustrates details of reservoir 42. This reservoir is constituted by an elongate bladder 41 which is a flexible foil of medium density polyethylene. The bladder features gusseted side-walls 64*a* and 64*b* running along a length of the bladder opposite one another. A distal end of the bladder proximate to wall 28 is used to fill the bladder with sample substance such as a lotion or cream. A crimp through heat application seals the distal end. Dispensing of the sample substance occurs at a front end of the bladder proximate to wall 26 and pump 34. The front end features an exit conduit 66 heat or adhesively welded to walls of the bladder.

An anti-collapse beam 68 is positioned along a length of the bladder inside thereof to support upper and lower bladder walls 70 and 72. The anti-collapse structure may come in a variety of different shapes but all function to insure that as sample substance is pumped from the bladder, the resultant vacuum should not cause sectional collapse of the bladder that might prevent full sample substance evacuation. Structure 68 may include apertures within the wall, may be a T-shape, and/or have only a plastic wire frame to minimize excess structural plastic.

Surrounding the bladder is the elongate rectangular paperboard carton 44. A paperboard second wall 74 is adhesively glued along one of the side walls of carton 44. Second wall 74 ensures a good friction fit within walls of the lower compartment 31 of the tray. The second wall 74 does not fully extend to the front end of the reservoir thereby leaving that end with a single wall cross-sectional footprint. The smaller sized footprint at the front end allows the carton to engage with receiving slots 76 in housing 32.

What is claimed is:

1. A combined sample dispenser and merchandising unit product display comprising:

(i) an elongate tray comprising a first end and a second end, an upper compartment with open roof for standing a plurality of merchandising unit products each containing a flowable substance, and a lower compartment arranged directly below the upper compartment;

(ii) a sample dispenser comprising a dispensing unit arranged against the first end of the tray and a reservoir holding sampling amounts of the flowable substance, communicating with the dispensing unit and arranged within the lower compartment; and (iii) a door positioned at the first end of the tray and movable from the upper compartment to the lower compartment upon removal of the reservoir from the lower compartment.

2. The combined sample dispenser and merchandising unit product display according to claim 1 wherein the dispensing unit is formed of a housing, the housing having a nozzle for dispensing sampling amounts of flowable substance, a mechanical pump and a lever for actuating the pump, the lever projecting outward from the housing.

3. The combined sample dispenser and merchandising unit product display according to claim 1 wherein the reservoir comprises a flexible bladder surrounded by a paperboard carton, the bladder being contractable as sampling amounts of flowable substance are dispensed.

4. The combined sample dispenser and merchandising unit product display according to claim 1 wherein the upper compartment is formed of a pair of side walls, first and second end walls, a floor, and the open roof is opposite the floor and defined by upper edges of the side and end walls.

5. The combined sample dispenser and merchandising unit product display according to claim 4 wherein the floor further comprises a set of parallel tracks for guiding a support panel urged forward by a spring.

6. The combined sample dispenser and merchandising unit product display according to claim 1 wherein the upper compartment and the lower compartment are co-extensive in length and width.

7. The combined sample dispenser and merchandising unit product display according to claim 1 wherein the tray along an exterior wall includes an indentation to interactively secure the reservoir within the lower compartment.

8. A method for allowing a consumer to test a flowable product prior to purchase comprising:

(A) providing a combined sample dispenser and merchandising unit product display comprising:

(i) an elongate tray comprising a first end and a second end, an upper compartment with open roof for standing a plurality of merchandising unit products each containing a flowable substance, and a lower compartment arranged directly below the upper compartment;

(ii) a sample dispenser comprising a dispensing unit arranged against the first end of the tray and a reservoir hiding sampling amounts of the flowable substance, communicating with the dispensing unit and arranged within the lower compartment; and (iii) a door positioned at the first end of the tray and movable from the upper compartment to the lower compartment upon removal of the reservoir from the lower compartment;

(B) placing the combined sample dispenser and merchandising unit product display on a shelf of a retail establishment; and (C) stocking the elongate tray with a plurality of merchandising unit products each containing the flowable substance.

* * * * *